US005216861A

United States Patent [19]

Meyerson

[11] Patent Number: 5,216,861

[45] Date of Patent: Jun. 8, 1993

[54] BUILDING PANEL AND METHOD

[75] Inventor: Steven C. Meyerson, Clearwater, Fla.

[73] Assignee: Structural Panels, Inc., Oldsmar, Fla.

[21] Appl. No.: 725,190

[22] Filed: Jul. 3, 1991

Related U.S. Application Data

[60] Division of Ser. No. 513,922, Apr. 24, 1990, Pat. No. 5,086,599, which is a continuation-in-part of Ser. No. 481,607, Feb. 15, 1990.

[51] Int. Cl.[5] ..... E04B 1/00; E04C 1/14

[52] U.S. Cl. ..... 52/309.9; 52/72; 52/780; 52/781; 29/897.35

[58] Field of Search ..... 52/729, 282, 732, 780, 52/781; 29/897.35

[56] References Cited

U.S. PATENT DOCUMENTS

| | | | |
|---|---|---|---|
| 1,885,330 | 11/1932 | Cherdron et al. | 52/729 |
| 2,363,164 | 11/1944 | Waller | 52/729 |
| 3,293,812 | 12/1966 | Hammitt | 52/779 |
| 3,362,056 | 1/1968 | Preller et al. | 29/897.35 |
| 3,712,005 | 1/1973 | Eschbach et al. | 52/585 |
| 3,854,260 | 12/1974 | O'Hanlon | 52/584 |
| 4,691,494 | 8/1987 | Gwynne | 52/732 |
| 4,748,783 | 6/1988 | Labelle | 52/593 |
| 4,754,587 | 7/1988 | Glaser | 52/586 |
| 4,769,963 | 9/1988 | Meyerson | 52/595 |

FOREIGN PATENT DOCUMENTS

| | | | |
|---|---|---|---|
| 202024 | 7/1980 | Fed. Rep. of Germany | 52/584 |
| 2461069 | 3/1981 | France | 52/584 |
| 72564 | 4/1970 | German Democratic Rep. | 52/584 |
| 687202 | 9/1979 | U.S.S.R. | 52/282 |
| 121459 | 6/1919 | United Kingdom | 52/729 |
| 2168732 | 6/1986 | United Kingdom | 52/309.5 |

*Primary Examiner*—James L. Ridgill, Jr.
*Attorney, Agent, or Firm*—Jack E. Dominik

[57] ABSTRACT

A joint, in one embodiment, between adjacent panels of sheet encased insulating material in which one lateral edge has an essentially frustoconical nose, and the other edge has a frustoconical pocket is disclosed. In an alternative embodiment, essentially frustoconical noses are at both lateral edges and the two adjacent panels are joined by means of an I beam embodying the interlock of the present invention. In both embodiments, the interlocking relationship is a function of the lateral edges of the cladding sheet, or in the flange of an I beam, in which one edge has a sealant pocket, and the opposite edge has a locking sealant press which engages the sealant pocket and thereby interlocks the panels as well as presses the sealant in the sealant pocket to compress and secure the same and to form a sealant gasket between the lateral edges of the sealant pocket and the locking sealant press.

2 Claims, 6 Drawing Sheets

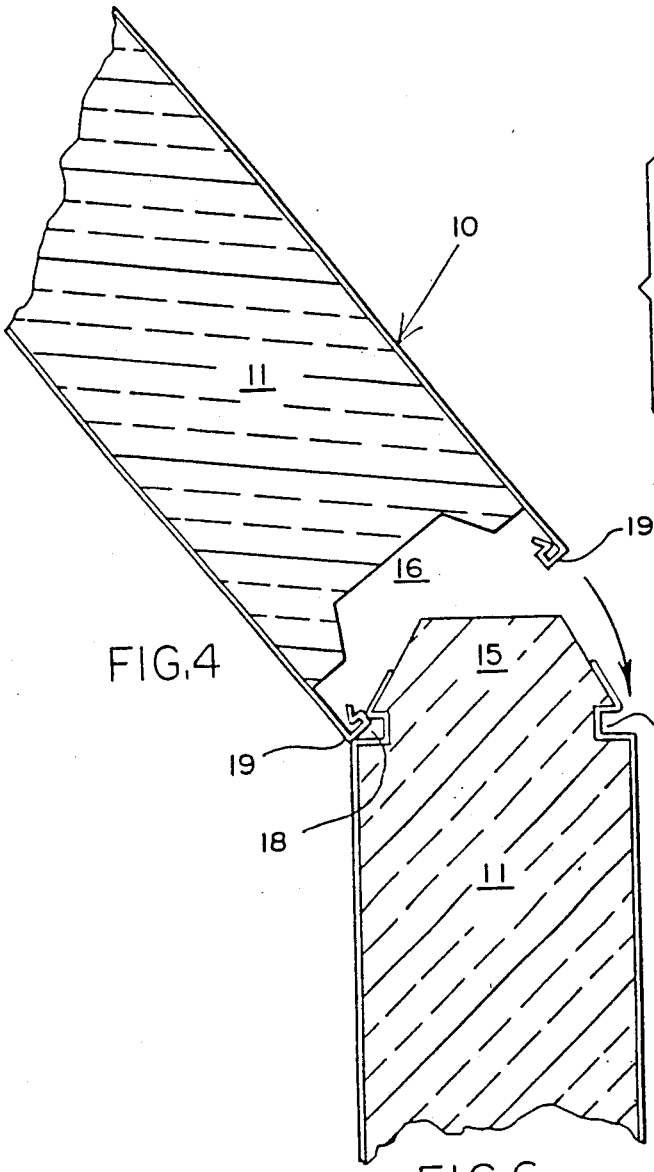
FIG.4
FIG.6
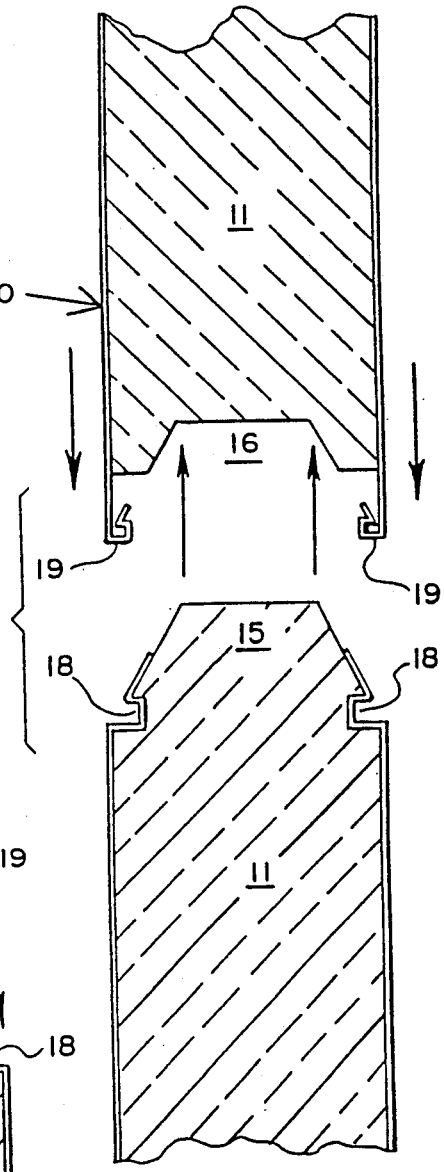
FIG.5

BUILDING PANEL AND METHOD

CROSS-REFERENCE TO RELATED APPLICATION

The present application is a Division of Ser. No. 513,922 filed Apr. 24, 1990 now U.S. Pat. No. 5,086,599 and allowed on Jan. 16, 1991, which in turn is a continuation-in-part of application Ser. No. 481,607 filed Feb. 15, 1990, entitled "Building Panel and Method" of the same inventor herein.

FIELD OF THE INVENTION

The present invention relates to building panels which may be used for roofing, or sidewalls, interior or exterior. The invention addresses itself specifically to a joint for such panels which interlocks adjacent panels and in which provision is made for sealing and locking the panels together.

SUMMARY OF THE PRIOR ART

The prior art is represented by U.S. Pat. No. 4,769,963 issued Sep. 13, 1988, the patents cited therein such as U.S. Pat. Nos. 3,367,076; 3,479,784; 3,742,672; 3,760,548; and 4,373,312 as well as 2,682,938 and U.S. Pat. No. 4,769,963.

The structures of the prior art do permit interlocking adjacent panels. The structure of U.S. Pat. No. 4,769,963 does an excellent job of interlocking but normally requires a direct press fit as distinguished from a rolling action which can be employed with a less precise joint. With all of the prior art patents, normally sealing is done after the panels are joined and at the seam. If the seam is tight, there is a problem in inserting the sealant at the seam where it can do its best job of bonding to adjacent edges together. Accordingly, the sealing often ends up as an exterior bead which, while acceptable for purposes of securing against leakage particularly where a joint is tight, it is less attractive than an unsealed closely abutting seam. Therefore, what is needed is a joint between adjacent panels in which sealant can be the subject of provision internally of the joint, and yet the sealant is assured to give the joint water-tight integrity.

In order to preseal with the construction shown in U.S. Pat. No. 4,769,963, there would have to be a shortening of the U-shaped structures 34 which would result in the end of the U-shaped structure not bottoming out in the channel 36 of edge 32. Therefore, from a standpoint of centering two adjacent panels, reliance must be had on the edge 24 of the core 16 projecting into the edge 22 of core 16 in an interlocking relationship between the foamed material in the dish-like geometry of end 24 and end 22. Thus the lateral stability as a function of the skin to provide for a centering relationship of the adjacent panels would be sacrificed if provision is made for a sealant pocket in the channel 36. This reinforces the desirability of providing for a sealant channel without sacrificing the centering ability of the roll-formed skin as distinguished from relying on the center foam portions to provide such centering.

SUMMARY OF THE INVENTION

The present invention derives from a joint, in one embodiment, between adjacent panels of sheet encased insulating material in which one lateral edge has an essentially frustoconical nose, and the other edge has a frustoconical pocket. In an alternative embodiment, essentially frustoconical noses are at both lateral edges and the two adjacent panels are joined by means of an I beam embodying the interlock of the present invention. In both embodiments, the interlocking relationship is a function of the lateral edges of the cladding sheet, or the flange of an I beam, in which one edge has a sealant pocket, and the opposite edge has a locking sealant press which engages the sealant pocket and thereby interlocks the panels as well as presses the sealant in the sealant pocket to compress and secure the same and to form a sealant gasket between the lateral edges of the sealant pocket and the locking sealant press. The method of the invention contemplates the steps of providing adjacent building panels with sealant pockets in a seal press, and thereafter filling the sealant pocket with a predetermined amount of sealant to the end that when the joints are compressed together, there will be sufficient excess sealant material to be extruded by the sealant press lock to form gaskets or fins between the sidewalls of the sealant pocket and the sidewalls of the locking sealant press. The invention further contemplates the provision of a stabilizer reversely folded on one edge of the sealant press to overly and snap-fittingly and centeringly engage the adjacent ramp. In essence the two opposed stabilizers serve as a vice to grip the two opposed ramps when the adjacent panels are assembled with the sealant in the sealant pocket.

In view of the foregoing it is a principal object of the present invention to provide building panels of the type which are essentially a sheet encased insulating core with opposed lateral edges which permit the same to be readily secured to each other, and also to accommodate a sealant which is interior of the joint, not exposed at the exterior seam, and yet has the structural and sealant integrity to secure against moisture penetration, air leakage, and other flow through the joint.

Yet another object of the present invention is to provide a joint between adjacent structural panels which does not require significantly increased amounts of insulating material or sheet cladding, and which can be formed with roll formed presses or extruders of the kind known in the art.

Yet another object of the present invention is to provide such a joint which will lockingly receive an adjacent panel, lockingly secure sealant in place, and yet provide for dimensional stability of the completed joint and sections of adjacent panels which permits the structure to be erected with modular panels knowing that the modular dimensions of the roof or sidewalls will be predetermined with accuracy based upon the coaction between the adjacent building panels. As a corollary, another objective is to utilize such a joint in which a vice-like relationship is achieved between the two opposing lateral edges at the joint and adjacent the sealant pocket.

A further and important objective of the present invention is to provide a joint as described which can be enjoyed in the construction of a flush mounted I beam which join the opposed edges of adjacent panels and thereby impart a significantly improved span capability with an attractive flush joint, and four sealing pockets as distinguished from the two where no I beam is employed.

BRIEF DESCRIPTION OF THE DRAWINGS

The present invention including the apparatus and method will be better understood as the following description proceeds taken in conjunction with the accompanying illustrative drawings, in which:

FIGS. 3A thru 3D show progressive interlocking steps, without use of sealant, from initial contact to sliding and expanding at edges to final nesting;

FIG. 4 is an illustrative partially broken view showing how the adjacent panels illustrative of the present invention can be assembled with a rocking motion;

FIG. 5 is a view in the same scale and perspective as FIG. 4 but illustrating how the illustrative panels can be assembled by thrusting one panel towards the other in the plane of the same;

FIG. 6 along with FIG. 5 illustrates how the two adjacent panels may be assembled;

DESCRIPTION OF PREFERRED EMBODIMENTS

Figure 1:
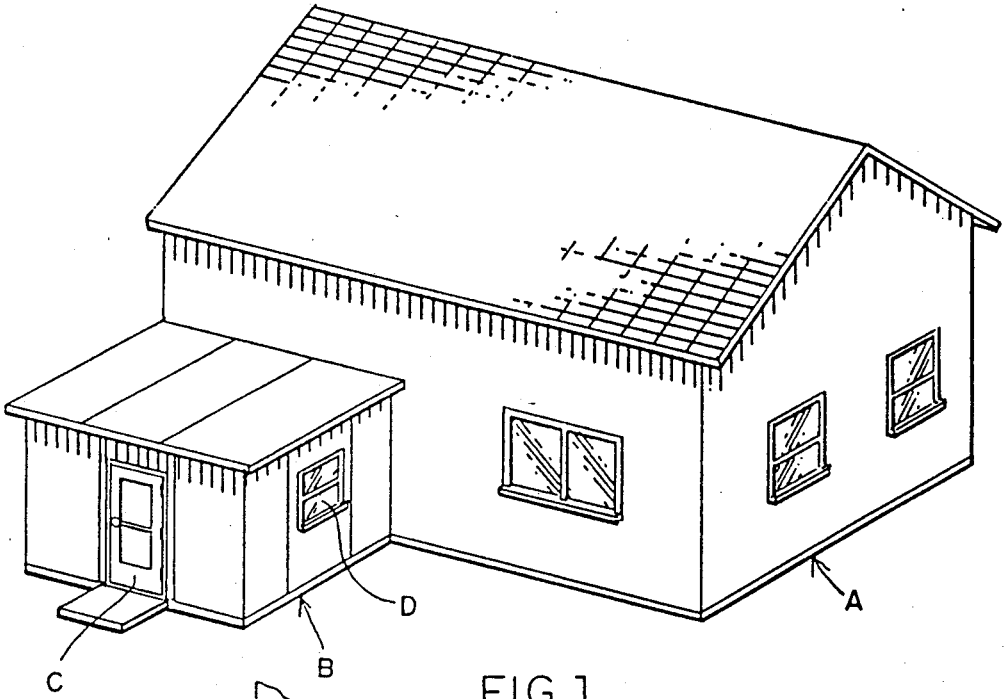
FIG. 1 is a perspective view of an illustrative house having an enclosed patio including doors and windows and which is constructed of panels illustrative of the present invention.
Figure 2:
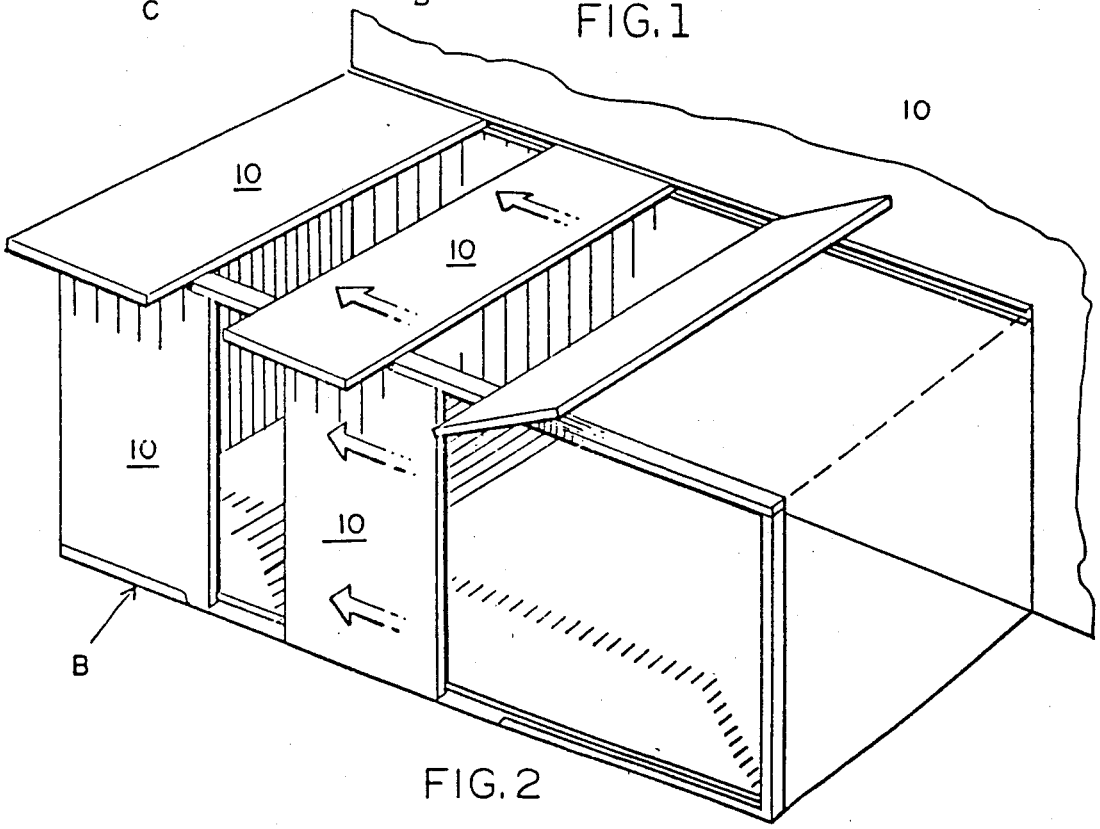
FIG. 2 is an enlarged view of the enclosed patio portion of FIG. 1, and showing sequentially how the panels are placed into position.

The subject invention of a structural panel and joint will be best understood in the environment of its usage. One embodiment to be described first is of two adjacent panels 10 having a single joint at their lateral edges. An alternative embodiment utilizes an I beam to join two adjacent panels and at the web end joints there are essentially four joints illustrative of the present invention. Turning now to FIG. 1, it will be seen that a house A has been supplied with an enclosed patio B which includes doors C, windows D, and the structural panel 10 illustrative of the invention. Turning now to FIG. 2, it will be seen that the house A and the enclosed patio B are made up by sequentially positioning the panels 10 adjacent each other and lockingly securing the same by press-fittingly engaging their opposed lateral edges. A version of the prior art is shown U.S. Pat. No. 4,769,963 of Sep. 13, 1988 in which the adjacent panels do have an opposed tongue-and-groove type construction. On the other hand, means are not provided at the lateral edges for pre-assembly sealing and lockingly and dimensionally accurately securing and centering the adjacent panels.

Figure 3B:
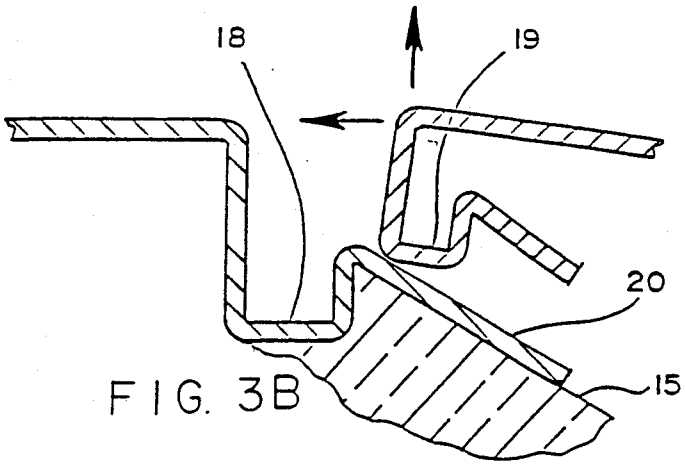
FIGS. 3A thru 3D show an enlarged view of an interlocking edge and sealant pocket showing the interlocking vice-like relationship between the edge and pocket.
Figure 3D:
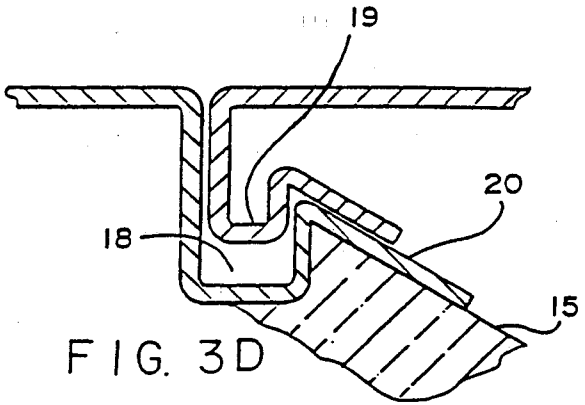
Figure 3A:
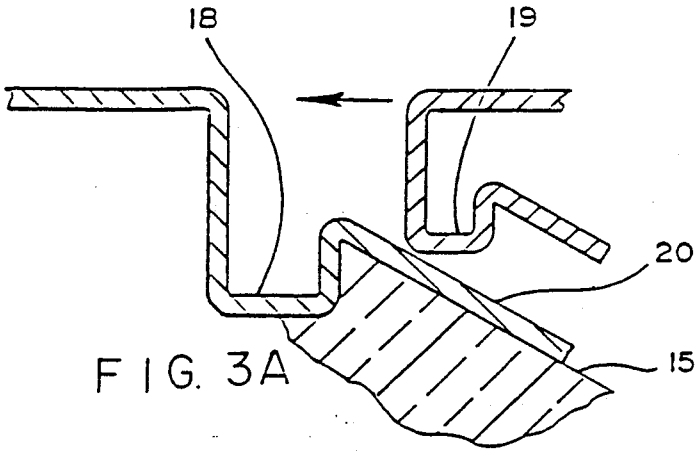
Figure 3C:
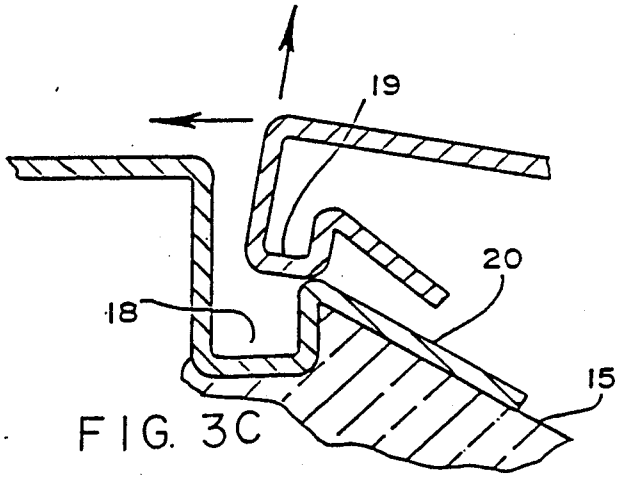

The panels illustrative of the first embodiment of the invention can be secured by sliding directly in opposed relationship, or rockingly engaging the one to the other. Such locking engagement sequence is illustrated in FIG. 3. FIG. 3*a* shows the locking sealant press 19 of one panel making initial contact with ramp 20 of an adjacent panel. FIG. 3*b* shows the locking sealant press 19 sliding up the ramp 20 21 and simultaneously flexing outward from the nose 15. FIG. 3C shows further sliding progression up the ramp 20 by the sealant press 19 and further outward expansion of the sealant press 19, reaching the final prelocking sliding position. FIG. 3D shows sealant press 19 snapped into sealant pocket 18 in vice-like locking relationship with sealant pocket 18. Such locking engagement is further illustrated in FIG. 4, where it will be seen that the panel 10 with its interior core 11 has the pocket 16 positioned opposite the nose 15 of the adjacent panel 10. The one panel is rocked with regard to the other until the locking pocket 18 is engaged by the locking sealant press 19 of the opposed panel as shown in the left-hand portion of FIG. 4. Thereafter, the panel is rotated essentially in the direction of the arrow as shown, until the opposite locking press 19 engages the opposed sealant pocket 18. In FIG. 5, the relationship of opposed panels is shown, and the arrow illustrates that the one panel 10 having a pocket 16 is moved in direct opposed parallel relationship to the opposite panel 10 toward the nose 15 and then the locking sealant presses 19, 19 substantially simultaneously fit into the sealant pockets 18.

Figure 7:
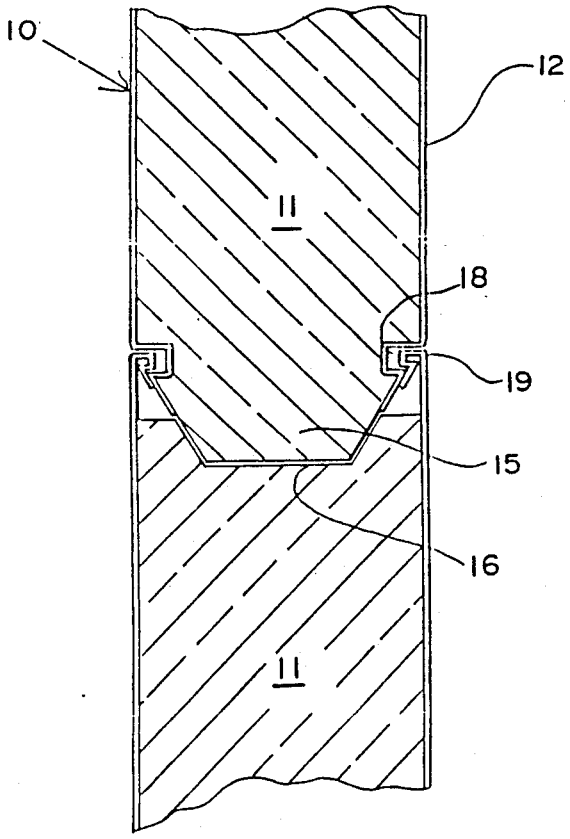
FIG. 7 is a sectional view of assembled panels showing how the nose of one panel is received by the pocket of the adjacent panel and secured in place by means of the sealant pocket and press.
Figure 8:
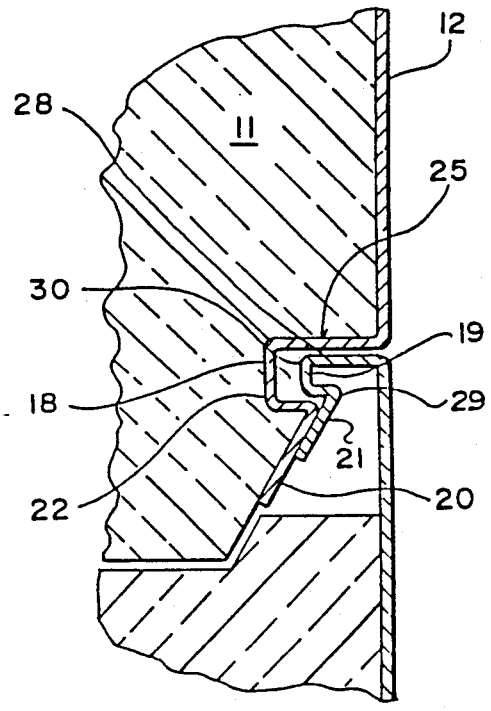
FIG. 8 is an enlarged view of the joint in FIG. 7, and showing more specifically the details as well as the location of the sealant material.

More specific details will be seen as the description of FIGS. 7 and 8 takes place. As will be seen in FIG. 7, the panel 10 is made up of a core material 11. This core material can be in a block of many thicknesses between one inch to eight inches in thickness. Commercial insulating grade of polystyrene is a desired material, but any material having comparable strength and insulating characteristics can be employed in a panel contemplated by the present invention. Such materials may include urethane, isocyranates, foamed or composite slabs, and honeycomb cores. The core 11 is covered by a skin 12 which is desirably laminated to the core 11. The skin 12 oftentimes is made up of aluminum having a thickness of 0.015 inches to 0.040 inches. While aluminum is a preferred material, other claddings including certain forms of plastics and steel are acceptable if they have the yieldable and formable characteristics at the joint portion. In addition, an aluminum encased steel sold under the trademark Galvalume is also an acceptable skin. In addition, the cladding or skin may be a composite. For example, an interior wall may have a formed metal joint at the lateral edge with a laminated interior finished wall portion such as wood panel, dry wall, chip board, or even wall paper. Finally, it will be noted that the nose 15 is provided in one of the panels 10 and is essentially frustopyramedal in its cross-section.

The opposite mating foam nose pocket 16 is similarly configured. While the two opposed members, namely nose 15 and pocket 16, have been shown in contact with each other, it is anticipated that a gap may be positioned between the nose 15 and the pocket 16, particularly because of the joint of the invention.

Turning now to FIG. 8, there it will be seen that the panel 10 with its core 11 and skin 12 is recessed in order to provide for a reversely formed portion of the skin 12 to define the sealant pocket 18. The sealant pocket 18 has a nose side 24, a panel side 25, and a bottom 22 which joins the two sides and is in substantially perpendicular relationship to both of the sides. The sealant pocket 18 terminates with a ramp 20 which parallels one of the sidewalls of the nose 15.

Opposite the sealant pocket is a locking sealant press 19 which press has a centering stabilizer 21 extending from the press portion and in substantially parallel relationship to the ramp 20. The sealant press 19 has a sealant press leading edge 28, and a sealant press trailing edge 29. The centering stabilizer 21 extends from the trailing edge 29. The centering stabilizer 21 is dimensioned so that, with its opposed centering stabilizer 21, it has a vice-like grip on the two adjacent ramps 20 to the end that centering of the two adjacent panels is assured, even though the locking sealant press bottom portion is spaced apart from the bottom 22 of the sealant pocket 18.

Quite important to this construction is the slide corner 30 of the sealant press 19 which slidingly engages the adjacent ramp 20 as was described previously in connection with FIGS. 3, 4 and 5. When the joint is concluded, a flex pocket 31 remains interiorly of the lateral extending edges of the skin 12 which has been formed to define the locking sealant press 19.

Figure 9:
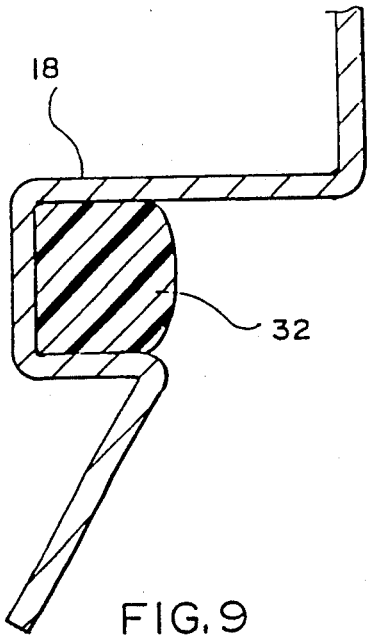
FIG. 9 is a further enlarged view of a portion of FIG. 8 showing how the pre-seal bead is inserted into the sealant pocket prior to assembling the panels.
Figure 10:
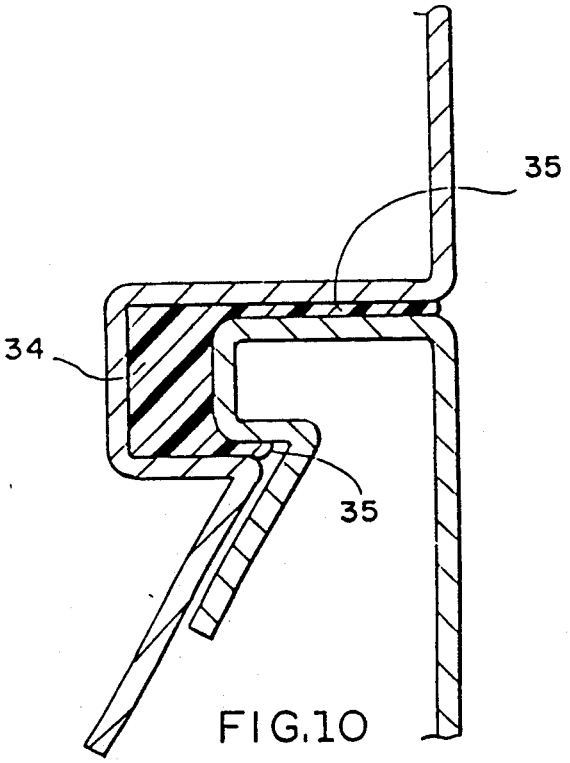
FIG. 10 is a view sequential to FIG. 9 and illustrating how the sealant is compressed in the sealant pocket and how sealant gaskets are extruded to be adjacent the lateral edges of the sealant pocket and the sealant press thereby defining a gasket.

In accordance with the use of the present invention, a preseal material 32 is positioned in the sealant pocket 18 as shown in FIG. 9. This preseal 32 is proportioned to essentially fill the sealant pocket 18 to an amount somewhat in excess of the space which will be provided after the locking sealant press 19 has been inserted. Turning now to FIG. 10, it will be seen that after the locking sealant press 19 has been inserted, the residual is a compressed sealant 34 in the base of the sealant pocket 18, and sealant gaskets 35 which are extruded as the sealant press 19 enters the sealant pocket 18. The result is not only the sealant at the base of the sealant pocket which under some circumstances is more than adequate to insure against leakage, but in addition the sealant gaskets 35 are defined which further reduce the likelihood of moisture penetration even into the joint. Conversely, the sealant gasket does not extend beyond the opposed edges of the skin 12 of the adjacent panels, and therefore is hidden from view and the panel joint appears to be one of closely abutting skin end portions which are neatly positioned adjacent each other. Finally, a centering relationship between the two adjacent panels 10 is assured by the vice-like grip the opposed centering stabilizers 21 have with the adjacent ramps 20.

THE METHOD

The method of the present invention presupposes the forming of structural panels in which opposed lateral edges have respectively a nose and a pocket 15, 16. The skin 12 portions of the opposed panels 10 are provided at their lateral edges with a sealant press extending from the nose pocket portion 16, and a sealant pocket 18 extending from the nose portion 15. The sealant pocket is filled with a bead of preseal 32 in an amount proportioned to exceed the ultimate available space between the bottom 22 of the sealant pocket, and the bottom of the locking sealant press 19. As the units are put together in accordance with the method, the compressed sealant 34 is defined in the sealant pocket 18, and portions of the sealing material are extruded to form sealant gaskets 35, between the opposed sidewalls of the locking sealant press 19 and the sealant pocket 18.

While the precise dimensions of the subject panels are not considered a detailed part of the invention, for illustrative purposes they do exemplify the proportions of the opposed members. Normal commercial practice utilizes a panel having a center core portion of approximately three inches in thickness. Therefore, the following dimensions which are set forth relate to utilization with a three inch thick panel. The lateral edges do not vary, however, between thicknesses of one inch and eight inches inasmuch as the structural integrity of the lateral edges is substantially independent of the thickness of the foam 11. The dimensions which are set forth as follows are based upon the tolerances and the dimensions used for utility with a wide variety of thicknesses of core material 11. The dimensions are set forth to particularly show the ratios of the lengths, widths, and depths of the various elements of the joint.

Figure 11:
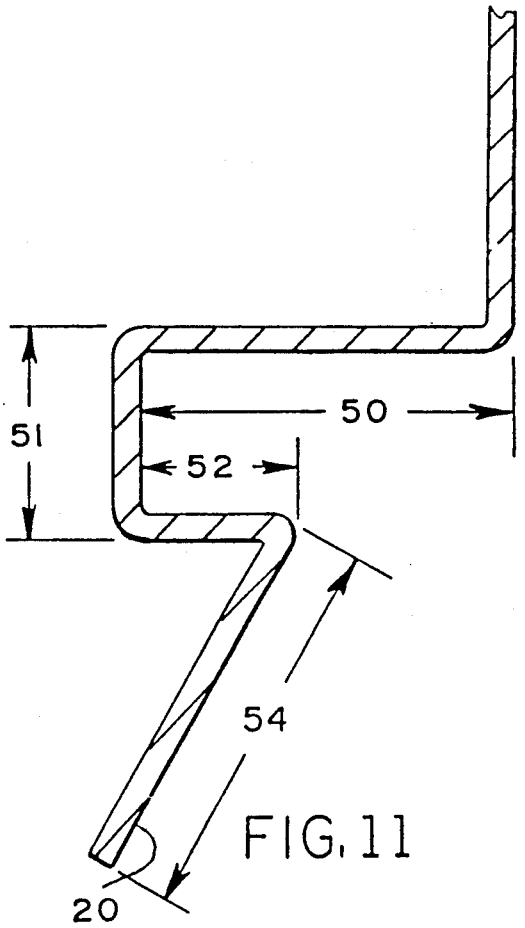
FIG. 11 is an enlarged view of the sealant pocket and showing exemplary dimensions of the same.

Thus, in FIG. 11, it will be seen that the depth of the pocket 18 is approximately 0.432 inches. The distance across the bottom 22 shown as reference numeral 51 is 0.25 to 0.50 inches. The depth of the nose wall of the pocket 18 identified as reference numeral 52 is between 0.187 and 0.25 inches. Finally, the ramp 20 shown as dimension 54 is between 0.25 and 0.50 inches.

Turning now to FIG. 2, it will be seen that the locking press leading edge identified by reference numeral 55 is approximately 0.30 to 0.25 inches. The head portion 56 of the locking press 19 shown as reference numeral 56 is between 0.15 and 0.40 inches. The return portion 58 which terminates in the centering stabilizer 21 is approximately 0.125 inches. The length of the centering stabilizer 21 shown by reference numeral 59 is between 0.25 and 0.375 inches.

Figure 12:
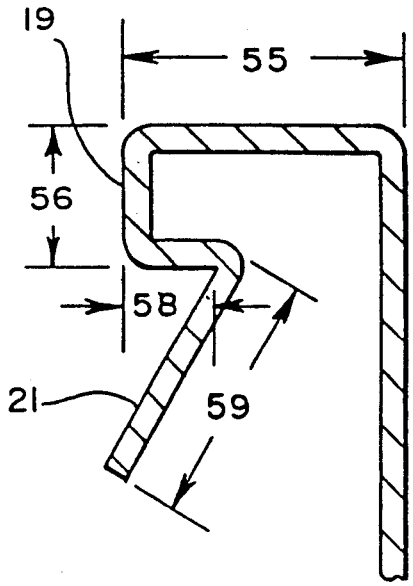
FIG. 12 is an enlarged view of the sealant press and showing exemplary dimensions of the same.
Figure 13:
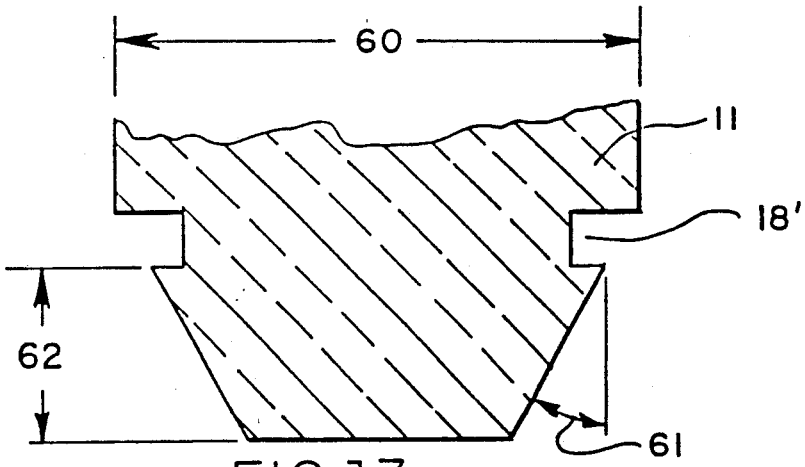
FIG. 13 is an enlarged view of the lateral edge nose of one panel showing illustrative dimensions.

For purposes of reference, the above dimensions shown in FIGS. 11 and 12 reference numerals 50-59 contemplate a insulating core material 11 which is approximately three inches thick. Thus turning to FIG. 13, the width of the core 11 is identified by reference numeral 60 and it is nominally to 8 inches. The pockets which are formed to receive the sealant pocket 18, 18' are approximately 0.475 inches deep, and between 0.25 and 0.50 inches wide. The angle of the frustoconical portion with the parallel skin 12 identified by reference numeral 61 is between 45° and 60°. The distance between the edge of the pocket 18' and that portion which abuts the adjacent panel shown by reference numeral 62 is approximately 0.50 to 1.0 inches.

Figure 14:
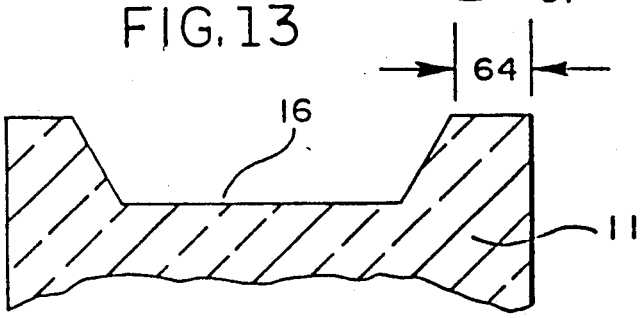
FIG. 14 is an enlarged view of a lateral edge of the panel showing the nose pocket and showing illustrative dimensions.

The pocket 16 as shown in FIG. 14 is between 0.25 and 0.50 inches deep, and between 1.0 and 8.0 inches wide, with the two flat portions identified by reference numeral 64 being approximately 0.375 and 0.50 inches, and the angle of taper being the same as the angle of the nose identified by reference numeral 61 in the range of 45° to 60°.

Figure 15:
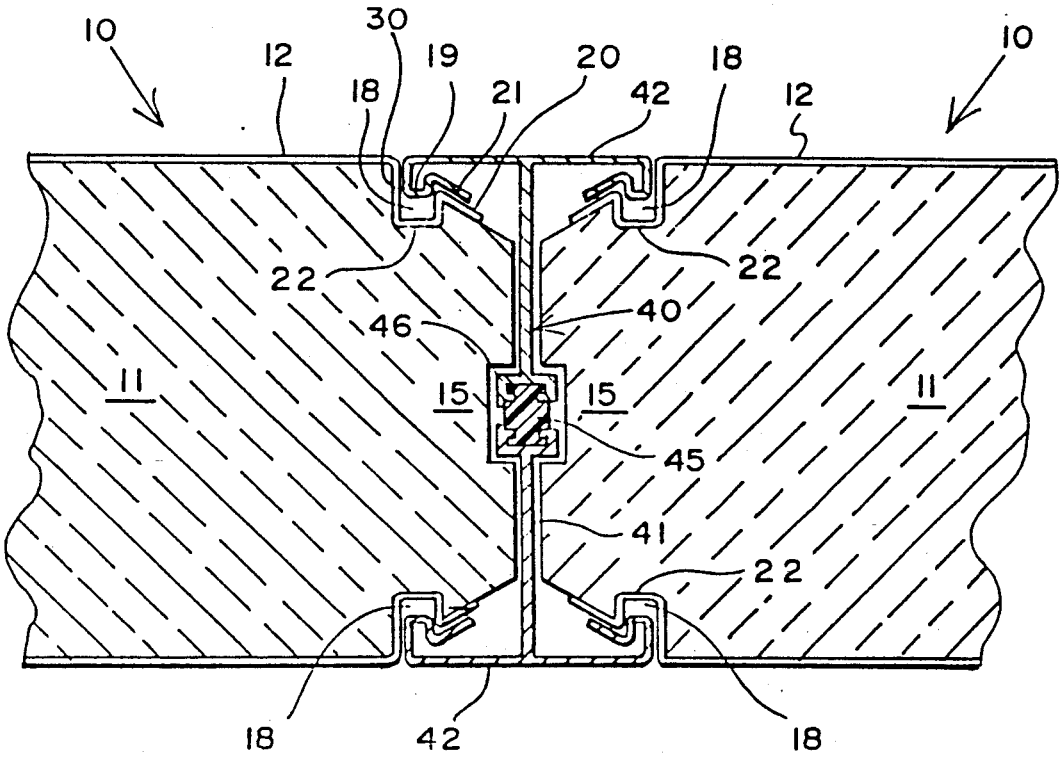
FIG. 15 is a transverse sectional view of two adjacent panels which are joined by an I beam employing the joint of the present invention.
Figure 16:
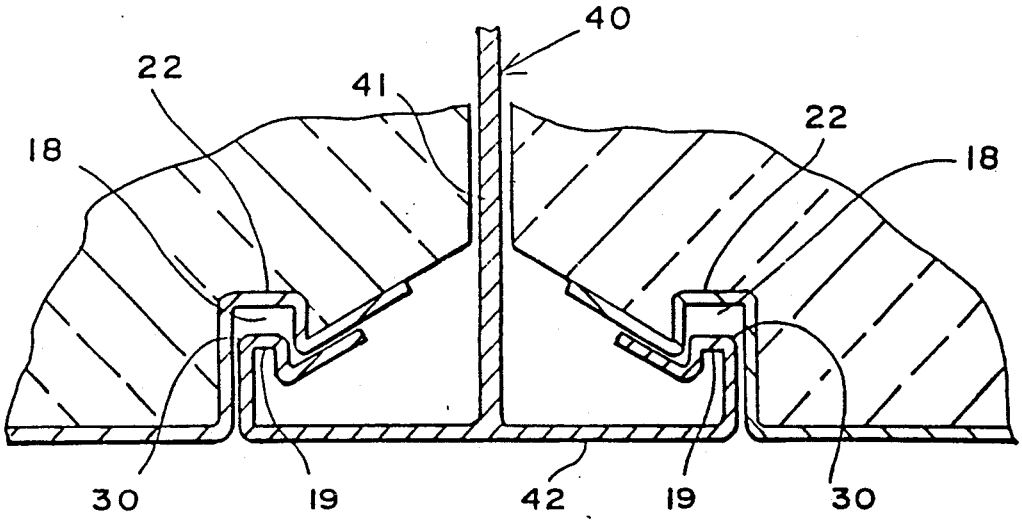
FIG. 16 is an enlarged view of the end of the I beam and the two adjacent joints in enlarged scale taken essentially where shown as circled in the lower portion of FIG. 15.

The alternative embodiment panel shown in FIG. 15 will be described using identical reference numerals to the first embodiment just described, where applicable to show the commonality of invention and joint usage. It will be seen in FIG. 15 that the two adjacent panels 10 have a pair of noses 15 which oppose each other. An I beam 40 is provided with a central web 41, and a pair of flanges 42 at either end of the web 41. An optional elastomeric spanner 45 is provided at the central portion 46 of the I beam web 41. At the opposite ends of each of the spanners 42 provision is made for a sealant pocket 18, a locking sealant press 19, a ramp 20, a centering stabilizer 21, and a bottom 22. The leading edge 28, trailing edge 29, slide corner 30, flex pocket 31 are the same as described in the first embodiment. The adjacent panels 10 are joined in essentially the same fashion as illustrated in FIGS. 4, 5, and 6. The sealant is applied in essentially the same fashion as illustrated in FIGS. 9 and 10. The I beam 40 is constructed with the flanges 42 so that the ends of the flanges 42 are flush with the skin 12 of the panel 10. The optional elastomeric member 45 is secured in the central area 46 of the web 41, and accommodates expansion and contraction where temperature differentials exist and thereby insures a flush fit. By utilizing the beam 40 significantly longer unsupported spans can be made, and the skin 12 can be reduced. The joint between the adjacent panels 10, however, is equally as well sealed as with the first embodiment and provision is made for four seals along with the flush mounted beam. The flush mounted beam 40 is made of varying thicknesses and the web 41 and flanges 42 can be of thicker material than those elements comprising the sealant press 19 and centering stabilizer 21.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed is:

1. An I-beam and panel combination in which said panel has a panel skin which sandwiches a core of structural foamed material and in which the edges of the skin have a sealant pocket comprising, said I-beam having a web, said web terminating at its remote ends with a pair of opposed parallel flanges, each of said flanges having a lateral edge, said lateral edges terminating with a reversely folded press member, said press member proportioned to receive a portion of the complimentary lateral sealant pockets of the lateral edges of said panel, whereby said beam may be employed to nestingly receive adjacent panels to form a wall structure with a sealant in a sealant pocket.

2. A wall structure comprising, in combination, a centrally disposed I-beam, said I-beam having a central web, flanges at the opposed ends of said web, each of said flanges having lateral edges, said lateral edges being reversely formed to define a sealing press, and a plurality of panels, said panels each having a central core of structural foam material clad with a formable skin, each said panel having a lateral edge formed with a sealant pocket in the skin, said I-beam flange presses and said panel sealant pockets being formed for a complimentary locking engagement with each other with the pockets receiving a portion of the presses, whereby a uniform structure can be assembled utilizing the adjacent panels and centrally positioned I-beam with a sealant in a sealing pocket.

* * * * *